US005986246A

United States Patent [19]

Lee

[11] Patent Number: 5,986,246

[45] Date of Patent: Nov. 16, 1999

[54] POWER SUPPLY CUT-OFF APPARATUS OF MICROWAVE OVEN

[75] Inventor: Jung-Ho Lee, Seoul, Rep. of Korea

[73] Assignee: Samsung Electronics Co., Ltd., Suwon, Rep. of Korea

[21] Appl. No.: 08/879,196

[22] Filed: Jun. 19, 1997

[30] Foreign Application Priority Data

Jul. 1, 1996 [KR] Rep. of Korea ..... 96-19548 U
Jul. 1, 1996 [KR] Rep. of Korea ..... 96-26634

[51] Int. Cl.[6] ..... H05B 6/68

[52] U.S. Cl. ..... 219/723; 219/722; 219/715; 219/756; 200/50.02; 200/61.62; 126/197

[58] Field of Search ..... 219/723, 722, 219/724, 756, 702, 715; 200/50.02, 50.14, 50.08, 50.1, 61.62, 61.76, 61.81; 126/197

[56] References Cited

U.S. PATENT DOCUMENTS 3,435,753 4/1969 Smith ..... 219/722
4,277,659 7/1981 DeRemer ..... 200/61.62

FOREIGN PATENT DOCUMENTS 55-56534 4/1980 Japan ..... 219/722
3-271630 12/1991 Japan ..... 219/756

*Primary Examiner*—Philip H. Leung
*Attorney, Agent, or Firm*—Burns, Doane, Swecker & Mathis, L.L.P.

[57] ABSTRACT

A power supply cut-off apparatus of a microwave oven includes a switch box, which is pivotally opened and closed, and provided at a prescribed position of an outer panel. A power supply connection unit is provided inside of the switch box and connected detachably to three power supply wires of an electric cord. A fuse is detachably provided in fuse fixing portions disposed on one side of the power supply connection unit.

3 Claims, 5 Drawing Sheets

POWER SUPPLY CUT-OFF APPARATUS OF MICROWAVE OVEN

BACKGROUND OF THE INVENTION

1. Field of the Invention

The present invention relates to a power supply cut-off apparatus of a microwave oven, and more particularly to a power supply cut-off apparatus of a microwave oven in which an input power supply can be automatically cut off when an outer panel is separated with an electric cord still being plugged in an outlet during a repair of the microwave oven.

2. Description of the Prior Art

A conventional microwave oven 60, as shown in FIGS. 1 and 2, includes a cooking chamber 10, a front panel 20, a back panel 30, a base panel 40, an outer panel 50, a turntable 70 disposed rotatably on a floor of the cooking chamber for rotating a food placed on an upper surface thereof, a door 80 for opening and closing the cooking chamber, and a control unit 90 for establishing a cooking selection mode or for operating a magnetron (not shown) or the like.

In order to drive the microwave oven thus constructed, a user opens the door 80, places food on the turntable 70 disposed on the floor of the cooking chamber, closes the door 80, and operates the cooking selection mode (not shown) of the control unit 90 according to the property of the food while an electric cord 100 is still in an outlet (not shown).

At this time, according to a supply of an electric source, the turntable 70 is rotated in one direction and a microwave of 2.45 GHz generated by an oscillating operation of the magnetron is radiated to the food on the turntable 70 within the cooking chamber through a waveguide (not shown) to thereby heat the food.

However, there is a problem in the conventional microwave oven thus constructed in that an electric shock can happen because there is no safety measure to automatically cut off the power supply applied to the microwave oven when the outer panel is separated in a state where the electric cord is still plugged in the outlet during a repair of the microwave oven.

SUMMARY OF THE INVENTION

Accordingly, the present invention is provided to solve the aforementioned problem and it is an object of the present invention to provide a power supply cut-off apparatus of a microwave oven in which an input power supply can be automatically cut off to thereby prevent an electric shock even if the outer panel is separated in a state where an electric cord is still plugged in an outlet during a repair of the microwave oven.

It is another object of the present invention to provide a power supply cut-off apparatus of a microwave oven in which a fuse can be easily replaced without disassembling an outer panel by providing one side of the outer panel with a switch box having a fuse.

To accomplish the object of the present invention, there is provided a power supply cut-off apparatus of a microwave oven comprising a switch box, which is pivotally opened and closed, provided at a prescribed position of the outer panel, and power supply connection means provided at an inside of the switch box and connected detachably to 3 power supply wires of an electric cord.

To accomplish another object of the present invention, there is provided a power supply cut-off apparatus of a microwave oven comprising a switch box, which is pivotally opened and closed, provided at a prescribed position of the outer panel, power supply connection means provided at an inside of the switch box, and a fuse provided at a prescribed position of one side of the power supply connection means.

DESCRIPTION OF THE PREFERRED EMBODIMENTS

Figure 1:
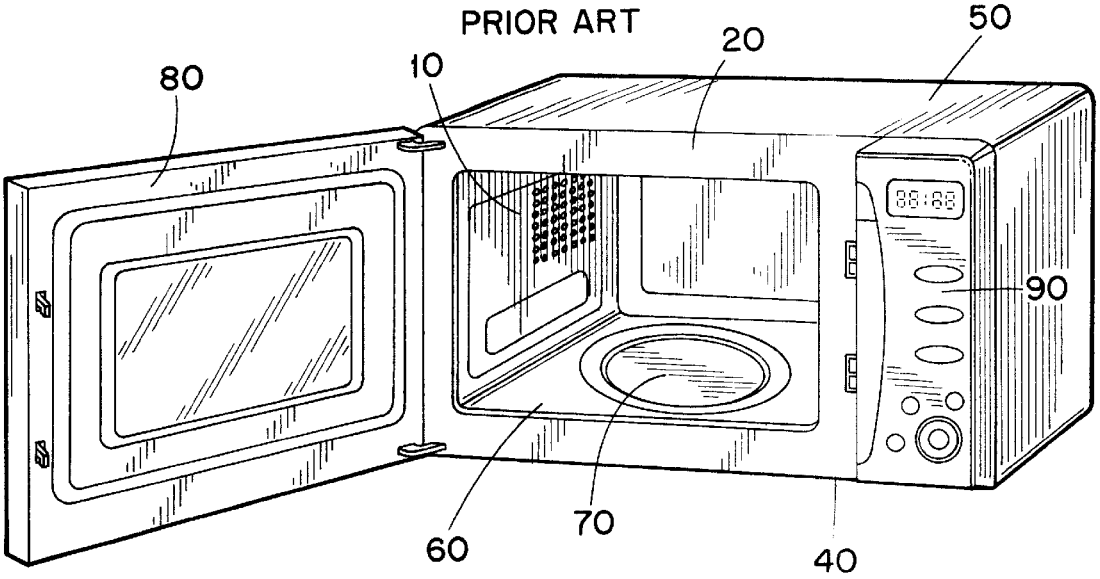
FIG. 1 PRIOR ART
FIG. 1 is a perspective view for showing a front surface of a microwave oven according to the prior art.
Figure 2:
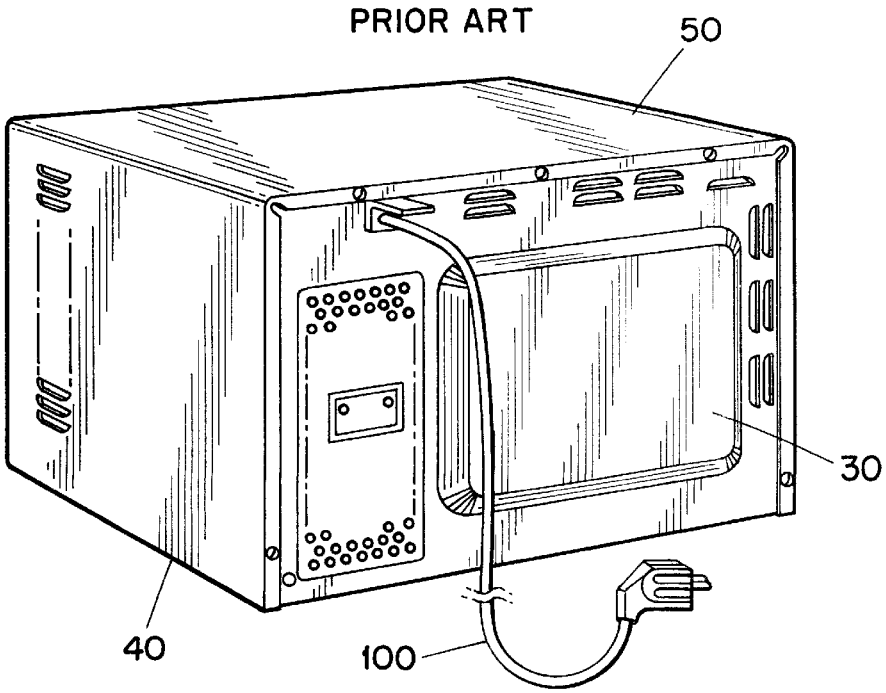
FIG. 2 PRIOR ART
FIG. 2 is a perspective view for showing a rear surface of a microwave oven according to the prior art.

Preferred embodiments of the present invention will be hereinafter described in detail with reference to accompanying drawings. Throughout the drawings, like symbols and reference numerals are used for designation of like or equivalent parts or portions, and redundant description will be omitted for simplicity of illustration and explanation.

Figure 3:
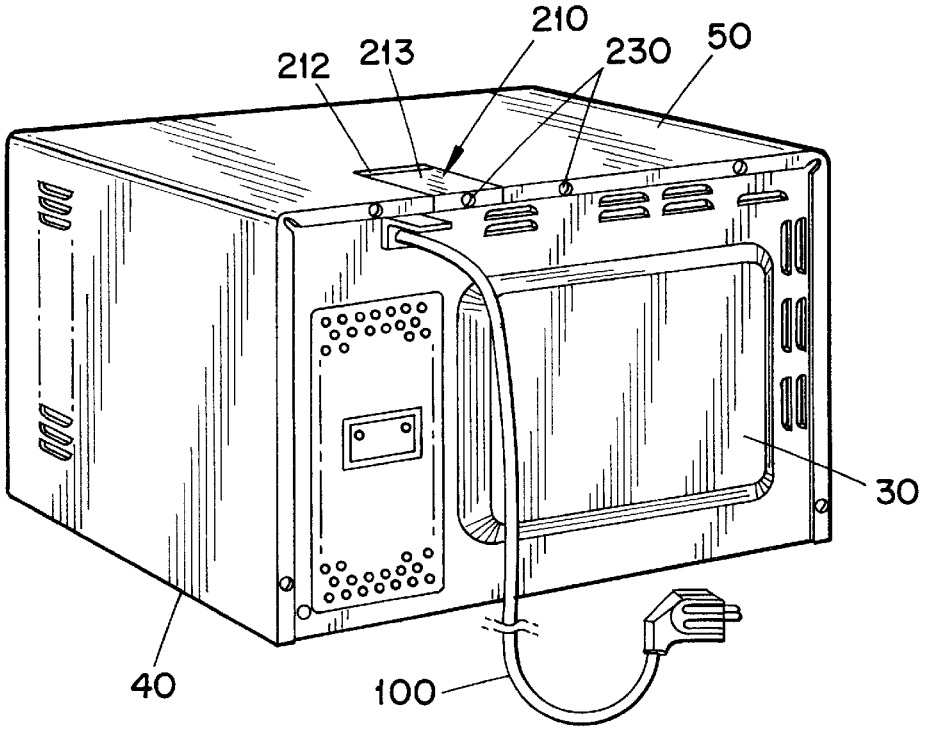
FIG. 3 is a perspective view for showing a rear surface of a microwave oven having a power supply cut-off apparatus according to the present invention.
Figure 4:
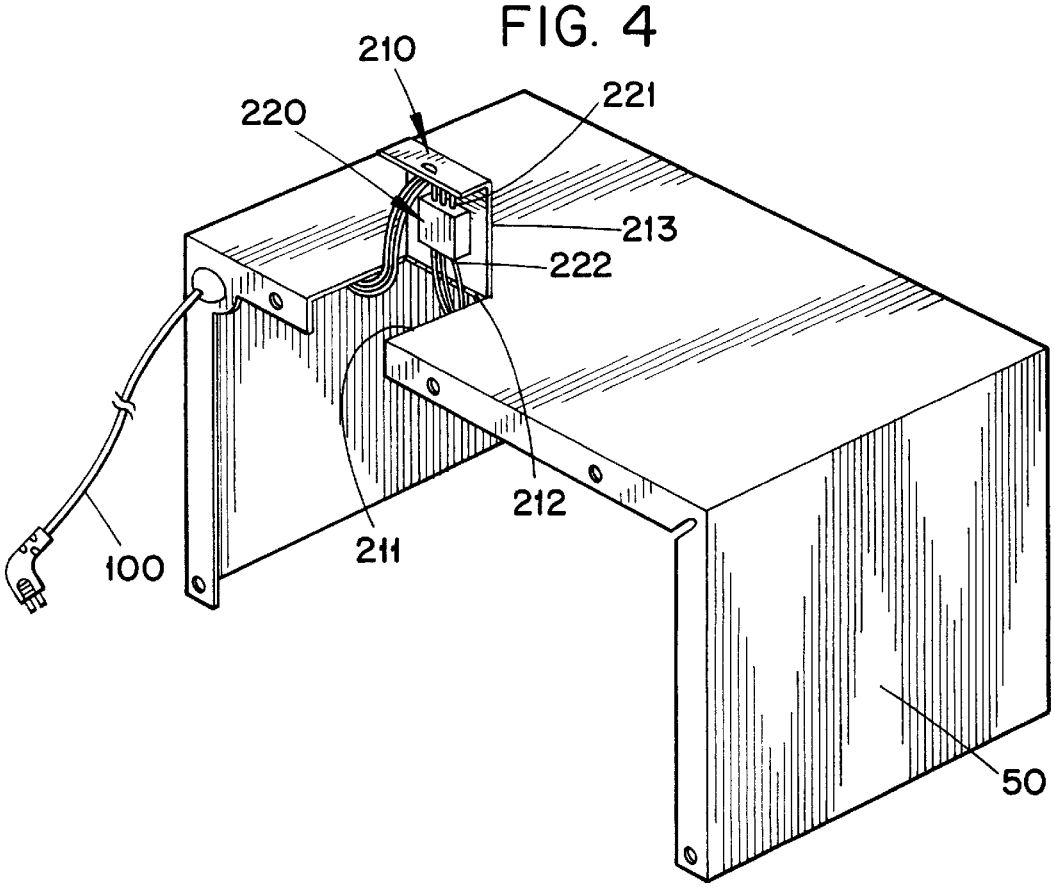
FIG. 4 is a perspective view for showing an outer panel provided with the power supply cut-off apparatus according to a first embodiment of the present invention.
Figure 5:
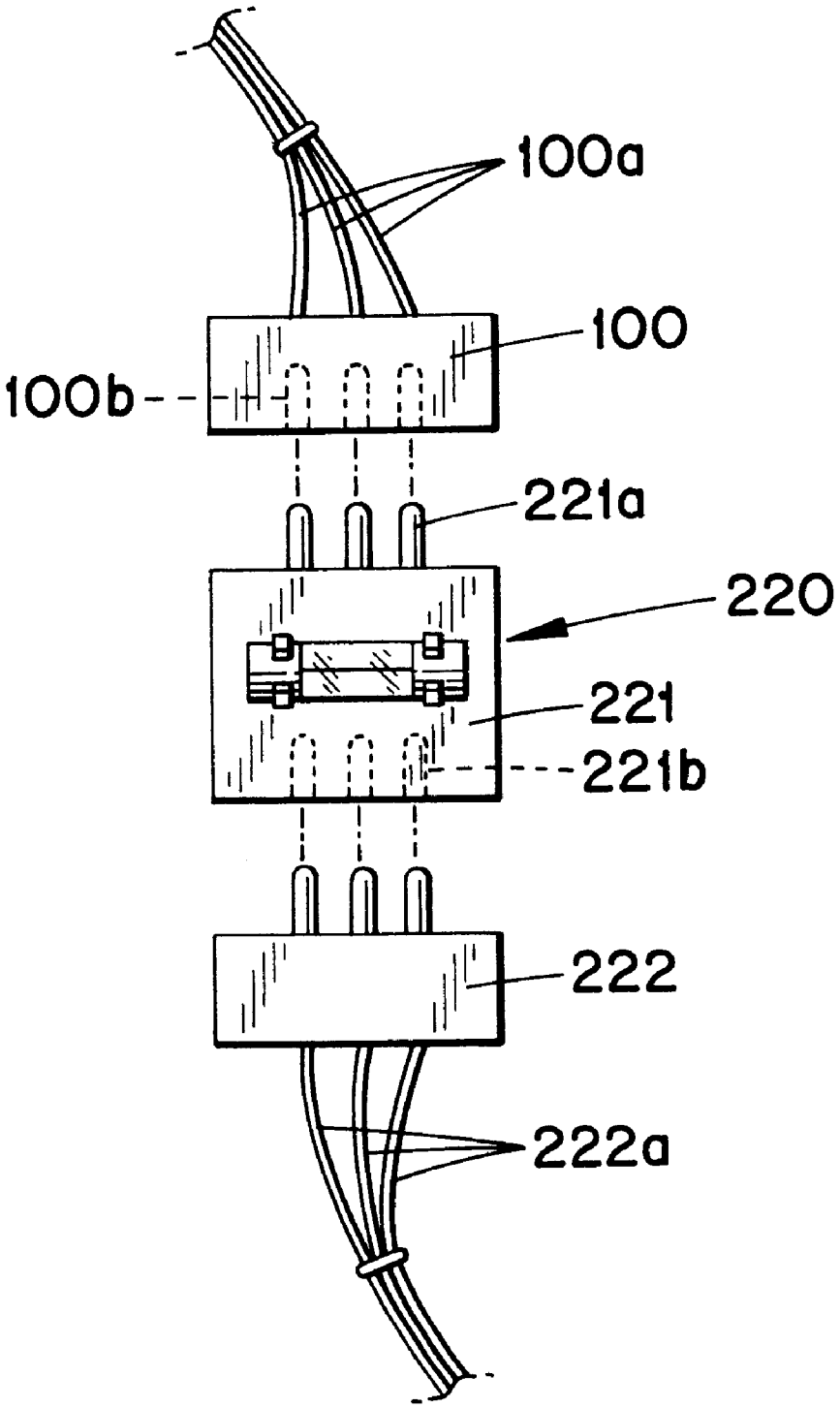
FIG. 5 is an exploded view for showing disassembled power supply wires and an adapter according to the present invention.

As shown in FIGS. 3 to 5, a power supply cut-off apparatus of a microwave oven according to the present invention includes a switch box 210 provided pivotally at a prescribed position of one side of the outer panel 50, and a power supply connection unit 220 installed inside of the switch box 210 so that a connection to the electric cord 100 can be detachably controlled.

As shown in FIG. 4, the switch box 210 comprises a cutaway portion 211 formed in a rear end portion of the outer panel 50 so as to communicate with the outside, and a cover plate 213 rotatably disposed in a hinged manner through a hinge pin 212 at one side of the cutaway portion 211 so as to open and close the area of the cutaway portion 211.

The power supply connection unit 220 includes an adapter 221 fixed at an inner surface of the cover plate 213 of the switch box 210 so as to detachably connect the electric cord 100 to a terminal 222 connected to electronic parts within the microwave oven.

At this time, as shown in FIG. 5, the adapter 221 is provided with male connection terminals 221*a* at one side thereof so that the male connection terminals 221*a* can be connected to three power supply wires 100*a* of the electric cord 100, and female connection terminals 221*b* at the other side thereof so that the female connection terminals 221*b* can be connected to three power supply wires 222*a* of the terminal 222.

Next, the operation and effect of the power supply cut-off apparatus of the microwave oven according to one embodiment of the present invention are hereinafter described in detail.

In order to repair the microwave oven, first of all, in a state shown in FIG. 3, a plurality of fastening screws 230 positioned at a rear external marginal area of the outer panel 50 are unfastened, to thereby separate the outer panel 50 from the back panel 30.

When the cover plate 213 of the switch box 210 disposed at one side of an upper portion of the outer panel 50 is lifted upward, the cover plate 213 is rotated about the hinge pin 212, so that the cover plate 213 extends upwardly as shown in FIG. 4.

Accordingly, an inner surface of the cover plate 213 is exposed to the outside, and the cutaway portion 211 is open.

At this time, the electric cord 100 and the terminal 222, connected to the three power supply wires 100*a*, 222*a* respectively, are separated from the adapter 221 fixed to the inner surface of the cover plate 213 as shown in FIG. 5, so that the outer panel 50 can be detached.

Besides, an electric shock can be prevented because the power supply applied to the microwave oven is automatically cut off in a state where the electric cord 100 is still plugged in the outlet during the repair of the microwave oven.

In addition, since one side of the electric cord 100 connected to the male connection terminals 221*a* of the adapter 221 is formed in a shape of female connection terminals 100*b*, an electric shock generated owing to a contact with the female connection terminals of the electric cord 100 can be prevented when the outer panel 50 is separated from the back panel 30 in a state where the electric cord 100 is still plugged in the outlet.

Furthermore, since the male terminal 222 is separated from the female connection terminal 221*b* of the adapter 221, a replacement or repair of electronic parts (not shown) in the microwave oven is easy and operation efficiency is increased.

According to the power supply cut-off apparatus of the microwave oven of the present invention as described above, the power supply cutoff apparatus is separately provided so that, first of all, the switch box installed at the outer panel is opened and the three power supply wires connected electrically are detached when the outer panel is separated in a state where the electric cord is still plugged in the outlet during a repair of the microwave oven, whereby an electric shock can be prevented during the repair of the microwave oven.

Now, a power supply cut-off apparatus of a microwave oven according to a second embodiment of the present invention will be described in detail with reference to FIGS. 6 and 7.

Figure 6:
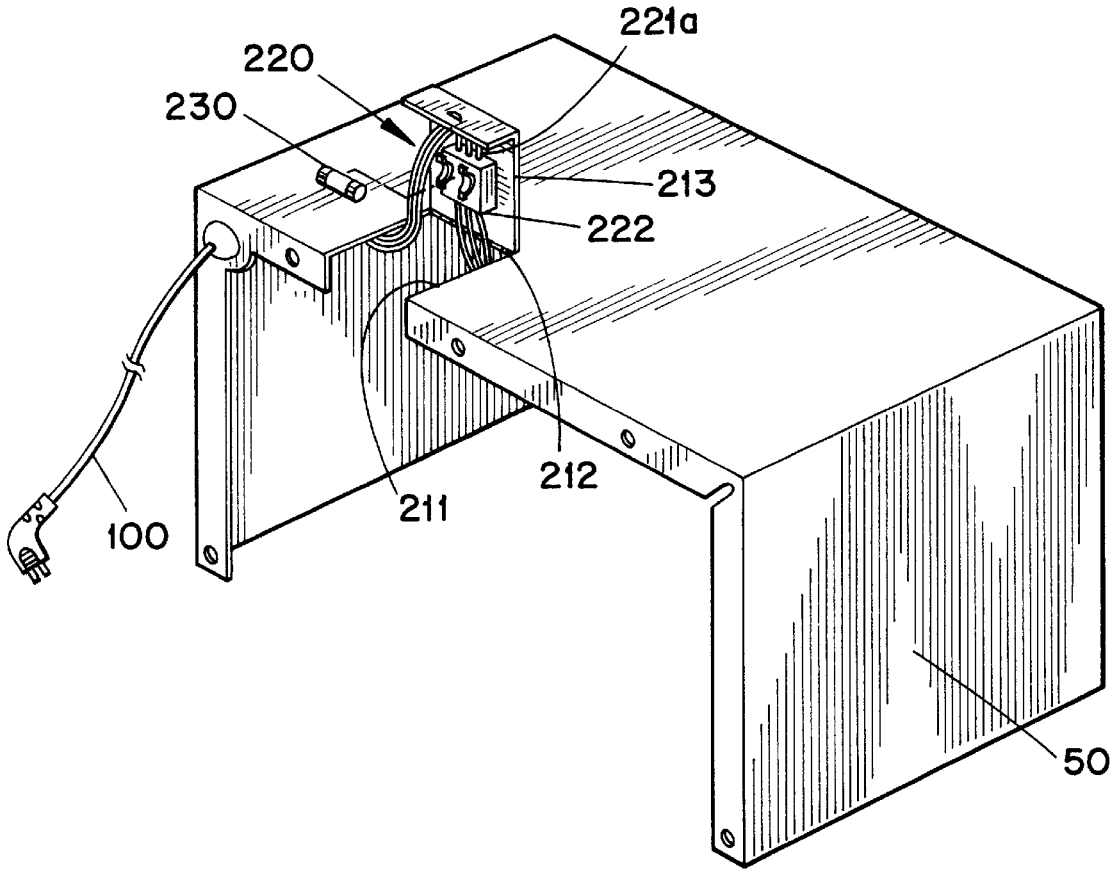
FIG. 6 is a perspective view for showing an outer panel provided with a power supply cut-off apparatus according to a second embodiment of the present invention.
Figure 7:
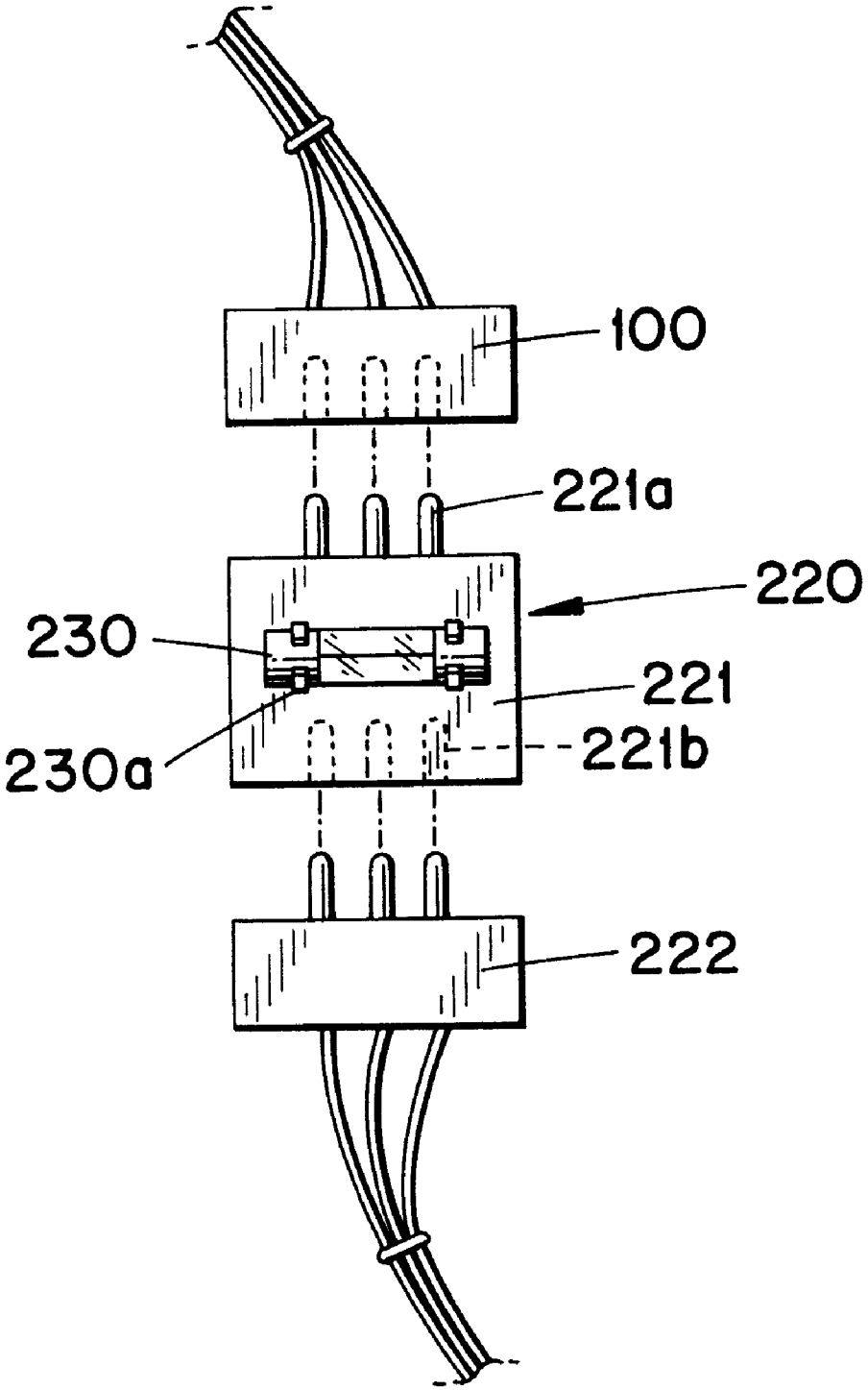
FIG. 7 is an exploded view for showing a disassembled power supply connection unit according to the second embodiment of the present invention.

As shown in FIGS. 6 and 7, the power supply cut-off apparatus according to the second embodiment of the present invention includes a switch box 210 provided rotatably at a prescribed position of one side of the outer panel 50, a power supply connection unit 220 installed at an inside of the switch box 210 so that a connection to the electric cord 100 can be detachably controlled, and a fuse 230 provided at the power supply connection unit 220 so that the fuse 230 cuts off the power supply to the microwave oven when an over voltage is applied through the electric cord 100.

As shown in FIG. 6, the switch box 210 comprises a cutaway portion 211 formed in a rear end portion of the outer panel 50 so as to communicate with the outside, and a cover plate 213 pivotally disposed in a hinged manner through a hinge pin 212 at one side of the cutaway portion 211 so as to open and close the area of the cutaway portion 211.

The power supply connection unit 220 includes an adapter 221 fixed at an inner surface of the cover plate 213 of the switch box 210 so as to detachably connect the electric cord 100 to a terminal 222 connected to electronic parts within the microwave oven.

At this time, the adapter 221 is provided with male connection terminals 221*a* at one side thereof so that the male connection terminals 221*a* can be connected to the three power supply wires 100*a* of the electric cord 100, and female connection terminals 221*b* at the other side thereof so that the female connection terminals 221*b* can be connected to the three power supply wires 222*a* of the terminal 222.

The fuse 230 is detachably provided in fuse fixing portions 230*a* formed on a central portion of the adapter 221.

Next, an operation and effect of the power supply cut-off apparatus of the microwave oven according to the second embodiment of the present invention are hereinafter described in detail.

In order to repair the microwave oven, first of all, in a state shown in FIG. 3, the plurality of fastening screws 230 positioned at a rear external marginal area of the outer panel 50 are unfastened, to thereby separate the outer panel 50 from the back panel 30.

When the cover plate 213 of the switch box 210 disposed at one side of an upper portion of the outer panel 50 is lifted upward, the cover plate 213 is rotated about the hinge pin 212, so that the cover plate 213 extends upwardly as shown in FIG. 6.

Accordingly, an inner surface of the cover plate 213 is exposed to the outside, and the cutaway portion 211 is open.

At this time, the electric cord 100 and the terminal 222, connected to the three power supply wires 100*a*, 222*a* respectively, are separated from the adapter 221 fixed to the inner surface of the cover plate 213 as shown in FIG. 7, so that the outer panel 50 can be detached.

Besides, an electric shock can be prevented because the power supply applied to the microwave oven is automatically cut off in a state where the electric cord 100 is still plugged in the outlet during the repair of the microwave oven.

In addition, since one side of the electric cord 100 connected to the male connection terminals 221*a* of the adapter 221 is formed in a shape of female connection terminals 100*b*, an electric shock generated owing to a contact with the female connection terminals of the electric cord 100 can be prevented when the outer panel 50 is separated from the back panel 30 in a state where the electric cord 100 is still plugged in the outlet.

Furthermore, since the male terminal 222 is separated from the female connection terminal 221*b* of the adapter 221, a replacement repair of electronic parts (not shown) in the microwave oven is easy and operation efficiency is increased.

In addition. since the fuse 230 can be easily replaced when the switch box 210 is opened, inconvenience and troublesomeness generated when the outer panel 50 is separated, can be avoided.

According to the power supply cut-off apparatus of the microwave oven of the present invention as described above, since the switch box, which is rotatably opened and closed, is provided at one side of the outer panel and the fuse is provided at the inner surface of the switch box, the separation of the outer panel is unnecessary during the replacement of the fuse, and the inconvenience and troublesomeness generated when the outer panel is disassembled can be avoided.

What is claimed is:

1. A power supply cut-off apparatus on a microwave oven having a separable outer panel at one side thereof, said outer panel including a cutaway portion formed in a rear end portion thereof, the apparatus comprising:

a switch box mounted on said outer panel to be pivotally opened and closed, said switch box including a cover plate pivotally mounted by a hinge pin at one side of said cutaway portion so as to open and close the area of said cutaway portion; and power supply connection means mounted inside of said switch box and connected detachably to three power supply wires of an electric cord.

2. The apparatus as defined in claim 1, wherein said power supply connection means comprises an adapter fixed on an inner surface of said cover plate of said switch box so as to detachably connect the three power supply wires of said electric cord respectively to three terminals connected to respective electronic parts within said microwave oven.

3. The apparatus as defined in claim 2, wherein said adapter comprises male connection terminals at one side thereof and adapted to be connected to the three power supply wires of said electric cord, and female connection terminals at the other side thereof and adapted to be connected to three power supply wires connected to said terminal.

* * * * *